US009433258B2

(12) United States Patent
Hetrick et al.

(10) Patent No.: US 9,433,258 B2
(45) Date of Patent: Sep. 6, 2016

(54) STRAP ADJUSTER AND KEEPER

(71) Applicant: Fitness Anywhere, LLC, San Francisco, CA (US)

(72) Inventors: Randal Hetrick, San Francisco, CA (US); Jordan Edward MacDonald, Palo Alto, CA (US); Stephanie Russo, San Francisco, CA (US); Andrew Siu, Hong Kong (CN); Yuen Kwok Wing, Hong Kong (CN)

(73) Assignee: Fitness Anywhere, LLC, San Francisco, CA (US)

( * ) Notice: Subject to any disclaimer, the term of this patent is extended or adjusted under 35 U.S.C. 154(b) by 21 days.

(21) Appl. No.: 14/092,471

(22) Filed: Nov. 27, 2013

(65) Prior Publication Data

US 2014/0082891 A1 Mar. 27, 2014

Related U.S. Application Data

(63) Continuation-in-part of application No. 13/194,522, filed on Jul. 29, 2011, now Pat. No. 8,840,532.

(60) Provisional application No. 61/730,883, filed on Nov. 28, 2012.

(51) Int. Cl.

| | |
|---|---|
| ***A44B 11/02*** | (2006.01) |
| ***A44B 11/25*** | (2006.01) |
| ***A63B 21/068*** | (2006.01) |

(Continued)

(52) U.S. Cl.

CPC ..... *A44B 11/02* (2013.01); *A44B 11/04* (2013.01); *A44B 11/25* (2013.01); *A44B 11/2557* (2013.01); *A63B 21/068* (2013.01); *A63B 21/1663* (2013.01); *A63B 21/4043* (2015.10); *A63B 23/03541* (2013.01); *A63B 21/154* (2013.01); *A63B 21/4035* (2015.10); *A63B 2071/0694* (2013.01); *A63B 2225/09* (2013.01); *Y10T 24/3987* (2015.01); *Y10T 24/4019* (2015.01); *Y10T 24/4084* (2015.01); *Y10T 24/4736* (2015.01)

(58) Field of Classification Search

CPC ..... Y10T 24/3987; Y10T 24/4736; Y10T 24/2164; Y10T 24/2192; Y10T 24/3404; Y10T 24/3927; Y10T 24/4093; Y10T 24/4084; A44B 11/006; A44B 11/02; A44B 11/005

See application file for complete search history.

(56) References Cited

U.S. PATENT DOCUMENTS

| | | | | |
|---|---|---|---|---|
| 186,128 | A | 1/1877 | Guerrero | |
| 1,133,396 | A * | 3/1915 | Parmenter ..... | A44B 11/006 24/191 |

(Continued)

OTHER PUBLICATIONS

Patent Cooperation Treaty, International Search Report and the Written Opinion of the International Searching Authority, issued in connection with International Application No. PCT/US2012/048525, mailed Jan. 30, 2013, 13 pages.

*Primary Examiner* — Robert J Sandy
*Assistant Examiner* — Michael Lee
(74) *Attorney, Agent, or Firm* — Vedder Price P.C.

(57) ABSTRACT

An apparatus including a combined strap-length adjuster and strap keeper is disclosed for use with multiple embodiments of a strap-length adjuster. A tether is used in combination with the strap keeper. The arrangement allows the tether to not interfere with the positioning or movement of the straps and maintains the straps close to the strap-length adjuster and prevents slippage of the strap through the strap-length adjuster.

7 Claims, 16 Drawing Sheets

(51) Int. Cl.

| | |
|---|---|
| ***A63B 21/16*** | (2006.01) |
| ***A63B 23/035*** | (2006.01) |
| ***A44B 11/04*** | (2006.01) |
| *A63B 21/00* | (2006.01) |
| *A63B 71/06* | (2006.01) |

(56) References Cited

U.S. PATENT DOCUMENTS

| | | | | |
|---|---|---|---|---|
| 2,269,696 | A | | 1/1942 | Shaulson |
| 3,063,718 | A | | 11/1962 | Steinkamp |
| 3,222,687 | A | | 12/1965 | Rosenzweig |
| 5,123,153 | A | * | 6/1992 | Krauss ..... A44B 11/10 24/171 |
| 5,205,021 | A | | 4/1993 | Durand |
| 5,285,555 | A | * | 2/1994 | Bell ..... A44B 11/10 24/171 |
| 5,518,486 | A | | 5/1996 | Sheeler |
| 6,726,606 | B2 | | 4/2004 | Jacobsen |
| 2006/0264302 | A1 | | 11/2006 | Sjodin |
| 2007/0066450 | A1 | | 3/2007 | Hetrick |
| 2007/0173383 | A1 | | 7/2007 | Feigenbaum et al. |
| 2007/0275796 | A1 | | 11/2007 | Carter |
| 2009/0075788 | A1 | | 3/2009 | Hetrick |

* cited by examiner

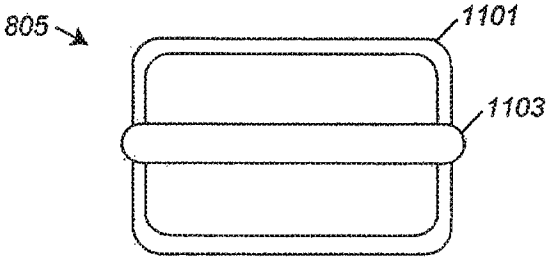
FIG. 11A
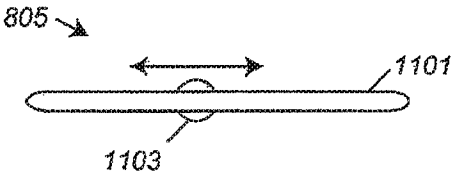
FIG. 11B
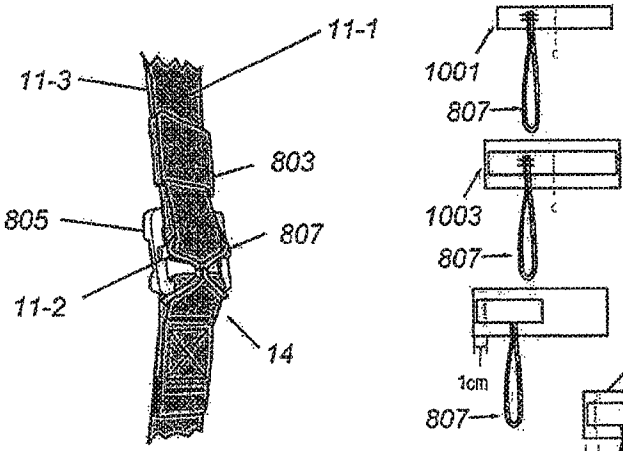
FIG. 10A
FIG. 10B
FIG. 10C
FIG. 10D
FIG. 10E
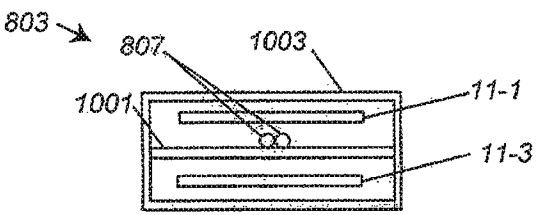
FIG. 10F

STRAP ADJUSTER AND KEEPER

CROSS-REFERENCE TO RELATED APPLICATIONS

The present patent application is a continuation-in-part of U.S. patent application Ser. No. 13/194,522, filed Jul. 29, 2011, entitled STRAP ADJUSTER AND KEEPER AND METHOD OF STRAP CONTROL, and claims the benefit of U.S. Provisional Patent Application No. 61/730,883, filed Nov. 28, 2012, entitled STRAP ADJUSTER AND KEEPER, which prior applications are hereby incorporated herein by reference.

FIELD OF THE INVENTION

The present invention generally relates to an apparatus having adjustable-length straps, and more particularly to an apparatus for strap control with a strap-length adjuster.

BACKGROUND

Mechanisms for adjusting the length of a strap, referred to herein as strap-length adjusters, are commonly used in belts, for tying down objects, and in adjustable exercise devices. Strap-length adjusters typically provide a gripping force on a strap at fixed positions (as in belt buckles) or at variable positions (using clamping devices). In both cases, the loose strap end protrudes away from the strap-length adjuster. In many instances, it is desirable to keep loose ends from moving by keeping them near the strap. Such devices are referred to as strap keepers. For some mechanisms, the movement of an end of the gripped strap may loosen the mechanism, rendering the mechanism ineffective.

In other instances, there is a possibility of the failure of components of the strap-length adjuster. This may have safety implications, as with, for example, an exercise device having straps to support the weight of the user. The failure of a component of the strap-length adjuster, such as a buckle, for example, may result in a user of the exercise equipment losing his or her balance and falling to the ground. It would be desirable to provide a mechanism that can stop, or at least minimize or slow down, a device from coming apart due to the failure of a component of the device.

There is a need in the art for an apparatus that includes a strap keeper that restrains loose strap ends near a strap-length adjuster. Such an apparatus should be easy to use and should automatically keep close to the strap-length adjuster. There is also a need in the art for an apparatus having a strap-length adjuster that can provide some safety to the user in the event of a failure of the components that support a strap.

SUMMARY

The present invention overcomes the disadvantages of the prior art by combining a tethered strap keeper with various designs of strap-length adjusters.

In accordance with one embodiment of the presently claimed invention, an apparatus is provided for attaching to a closed loop of a first strap and for providing a gripping force to a second strap having a free end. The apparatus includes a strap keeper, a strap-length adjuster, and a tether attached to the strap keeper.

In accordance with one embodiment of the presently claimed invention, an apparatus is provided for attaching to a closed loop of a first strap and for providing a gripping force to a second strap having a first portion and a second portion, wherein said first portion is folded over adjacent to said second portion, said apparatus comprising:

- a strap restraint, wherein said strap restraint encircles said first portion and said second portion, holding said first portion adjacent to said second portion;
- a tether, wherein said tether is operatively connected to said closed loop and is operatively connected to said strap restraint; and
- a strap-length adjuster, comprising:
  - a frame comprising a first bar and a second bar; and
  - a movable gate, wherein said movable gate is movably connected to said frame and is separated from said first bar by a first opening and from said second bar by a second opening;
- wherein said closed loop encircles said first bar; and
- wherein said second strap passes through said first opening, over said movable gate, through said second opening, and under said second bar.

In accordance with one embodiment of the presently claimed invention, an apparatus is provided for attaching to a closed loop of a first strap and for providing a gripping force to a second strap having a first portion, a second portion, and a free end, wherein said first portion is folded over adjacent to said second portion, said apparatus comprising:

- a strap restraint, wherein said strap restraint encircles said first portion and said second portion, holding said first portion adjacent to said second portion;
- a tether, wherein said tether is operatively connected to said strap restraint and is operatively connected to said closed loop; and
- a strap length adjuster, comprising:
  - a frame, comprising a first end including an interior surface, a second end, a first crossbar, and a second crossbar,
  - wherein said first crossbar is separated from said first end by a first opening, said first crossbar is separated from said second crossbar by a second opening, said second crossbar is separated from said second end by a third opening, and said interior surface is located on the portion of said first end which faces said first crossbar; and
- wherein said first strap passes under said second end, through said third opening, over said second crossbar, and through said second opening such that said closed loop encircles said second crossbar; and
- wherein said second strap passes through said second opening, over said first crossbar, through said first opening, adjacent to said interior surface, and under said first end.

In accordance with one embodiment of the presently claimed invention, a method is provided for providing strap control using a strap restraint with a strap-length adjuster adapted to connect to a first strap which includes a closed loop and adapted to accept a free end of a second strap, said strap-length adjuster comprising a first bar, a second bar, and a third bar with a first opening disposed between said first bar and said second bar and a second opening disposed between said second bar and said third bar comprising:

- attaching said first strap to said third bar so that said third bar is located within said closed loop;
- using a tether to connect said closed loop to said strap restraint; and
- passing said free end through said strap restraint, through said second opening, over said second bar, through said first opening, under said first bar, and through said strap restraint such that said strap restraint holds said free end adjacent to said second strap;

wherein said second strap is restrained by said strap restraint when said second strap is pulled away from said strap restraint in a direction parallel to the plane formed by said first bar and said second bar; and wherein said second strap may move freely through said strap restraint when said second strap is pulled in a direction perpendicular to the plane formed by said first bar and said second bar.

These features together with the various ancillary provisions and features which will become apparent to those skilled in the art from the following detailed description, are attained by the combined strap-length adjuster and strap keeper of the present invention, preferred embodiments thereof being shown with reference to the accompanying drawings, by way of example only, wherein:

BRIEF DESCRIPTION OF THE SEVERAL VIEWS OF THE DRAWINGS

FIG. 10A is a perspective view of one embodiment of a tethered strap keeper and a strap-length adjustment mechanism;

FIGS. 10B, 10C, 10D, and 10E are assembly drawings for one embodiment of a tethered strap keeper;

FIG. 10F is a sectional view of FIG. 8B;

FIGS. 11A and 11B are a top view and a side view, respectively, of a first embodiment of a barrel lock

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
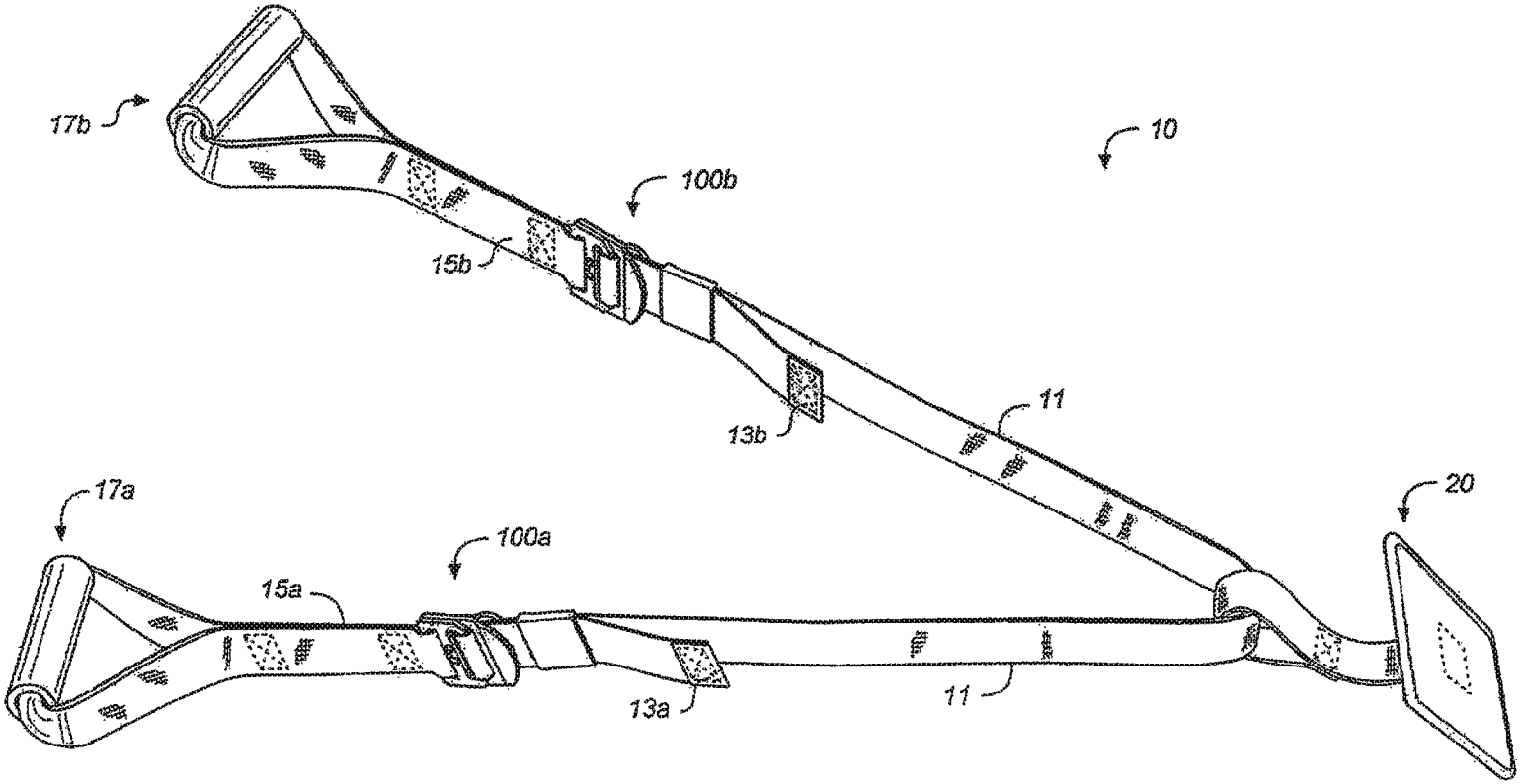
FIG. 1 is a perspective view of a first embodiment of a strap adjuster and keeper.

FIG. 1 illustrates one embodiment of strap adjuster and keeper 100, shown as a strap adjuster and keeper 100*a* and 100*b* as utilized in an exercise device 10. Exercise device 10 is shown for illustrative purposes only and is not meant to limit the scope of the present invention, except as explicitly claimed.

Exercise device 10, for example, includes a door mount 20, a first inelastic strap 11 having a first free end 13*a* and a second free end 13*b*, and second and third inelastic straps 15*a* and 15*b* terminating in grips 17*a* and 17*b*, respectively. First strap adjuster and keeper 100*a* and second strap adjuster and keeper 100*b* accept free ends 13*a* and 13*b*, respectively, and permit adjustment of the supporting length of first strap 11 (where the length may be measured, for example and without limitation, as the distance between grips 17*a* and 17*b*, or the distance between one of grips 17*a* or 17*b* and door mount 20), by pulling on one or more of first free end 13*a* and second free end 13*b*, as discussed subsequently. First strap adjuster and keeper 100*a* and second strap adjuster and keeper 100*b* also support second strap 15*a* and third strap 15*b*, respectively. Examples of exercise device 10 may be found, for example and without limitation, in co-owned U.S. Pat. Nos. 7,044,896 and 7,762,932, the contents of which are incorporated herein by reference.

Figure 2:
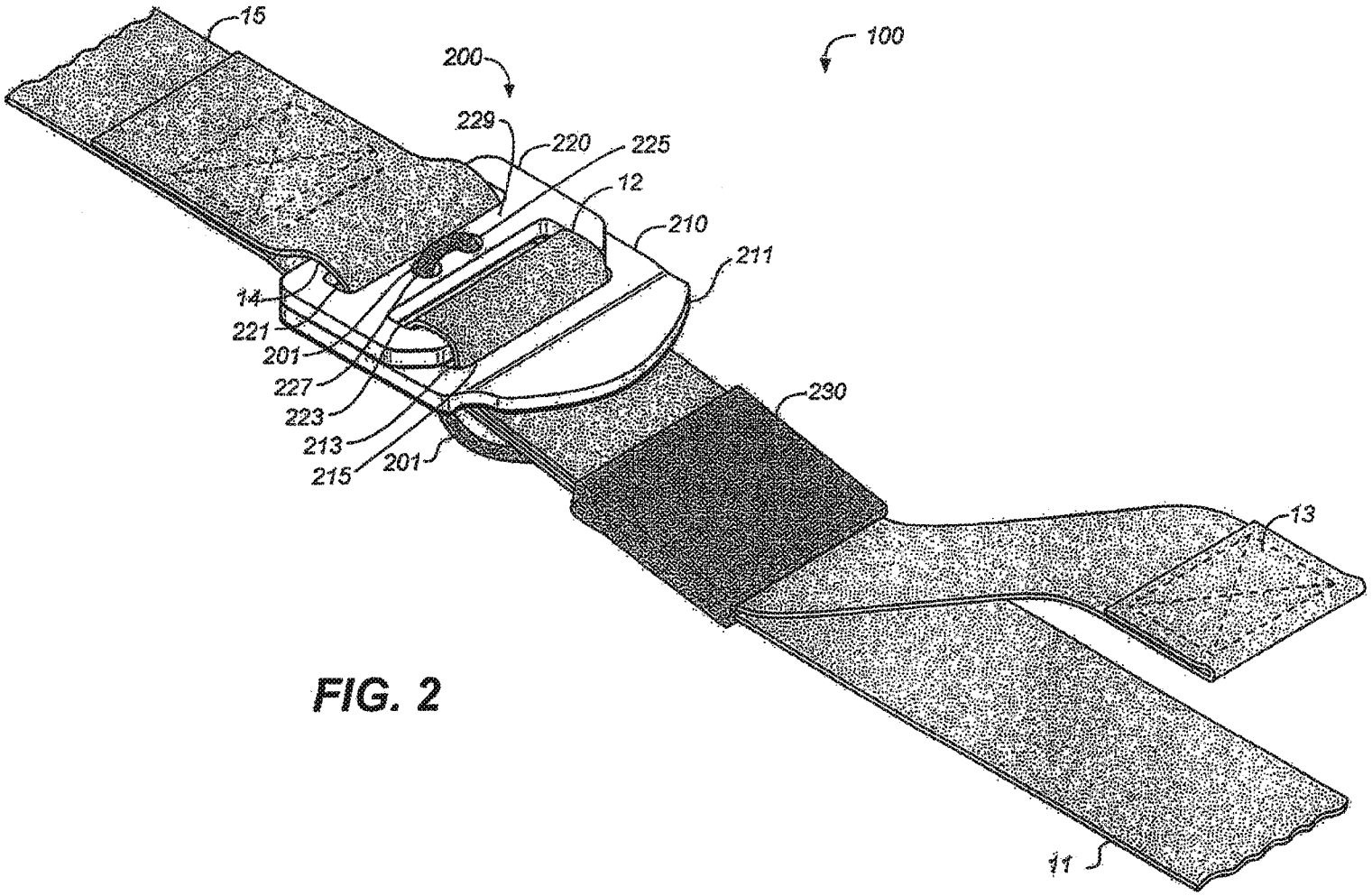
FIG. 2 is a detailed perspective view of the first embodiment of the strap adjuster and keeper.
Figure 3A:
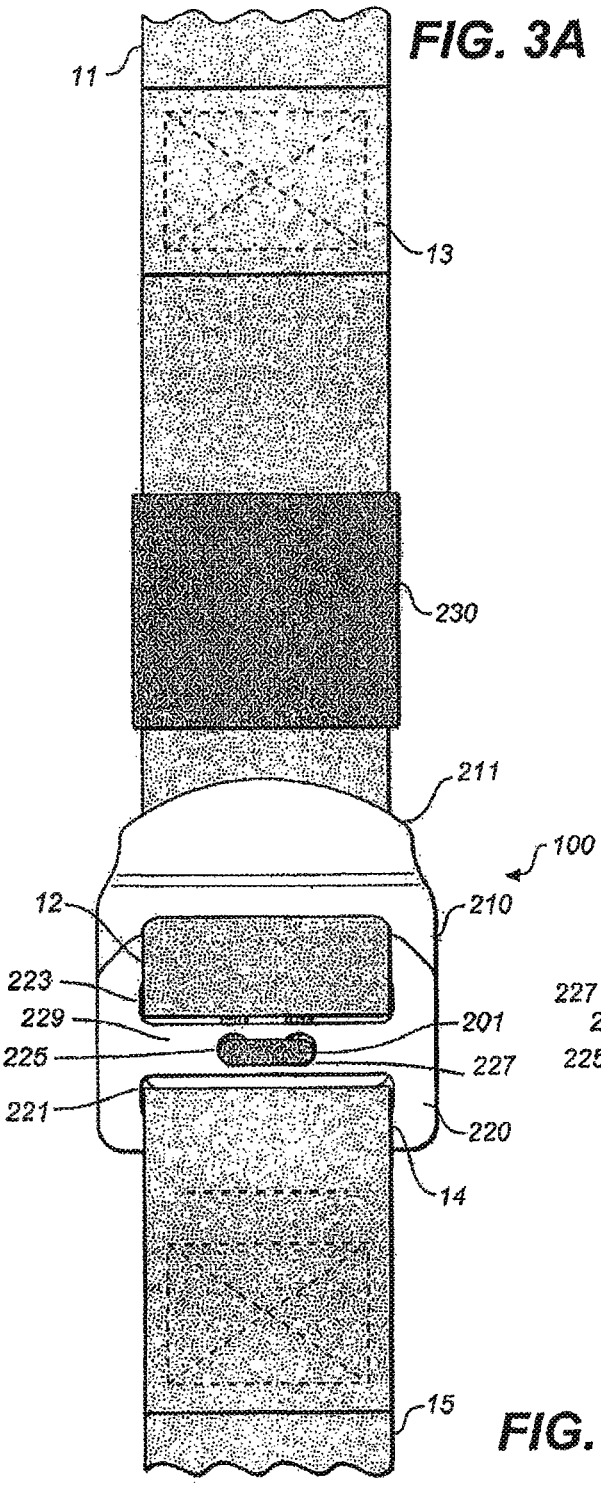
FIGS. 3A and 3B are a top and bottom view, respectively, of the strap adjuster and keeper of FIG. 2.
Figure 3B:
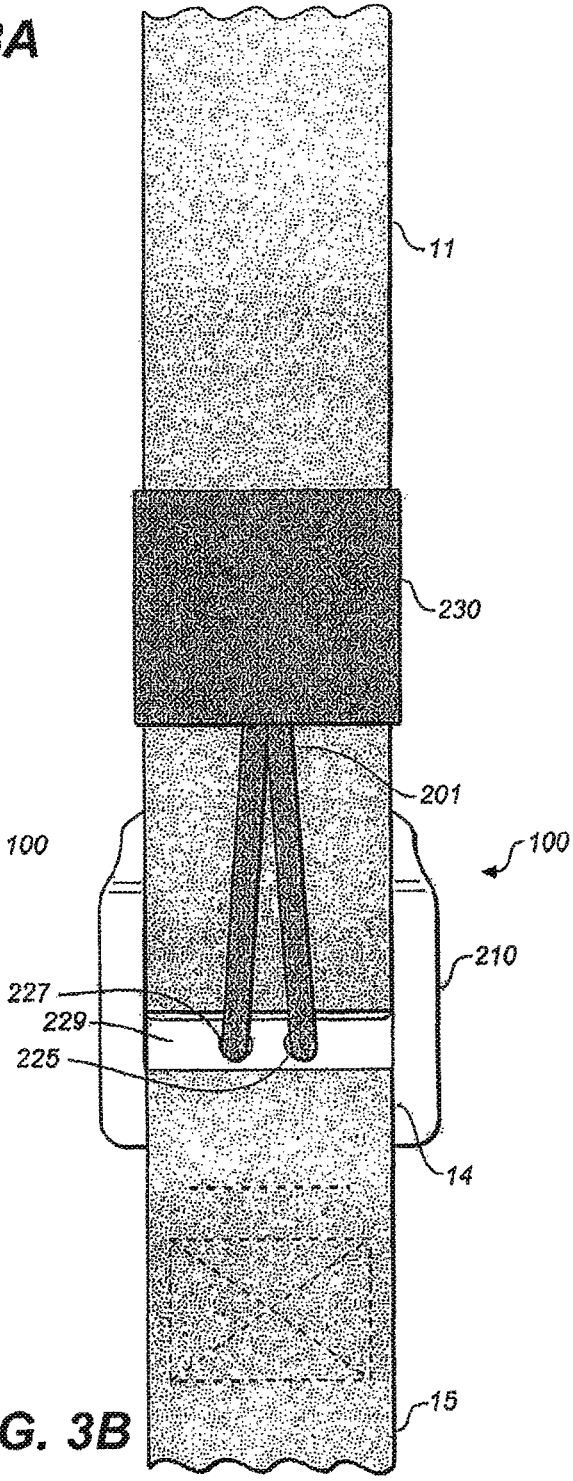
Figure 4A:
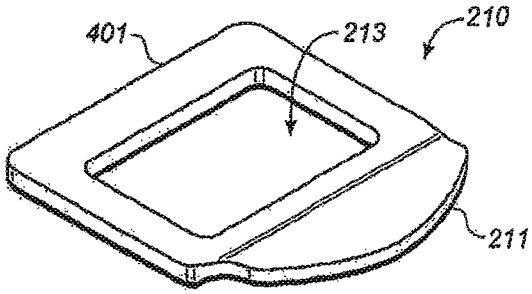
FIGS. 4A, 4B, and 4C are perspective, top, and side views, respectively, of the first element of the first embodiment of a strap-length adjuster.
Figure 4B:
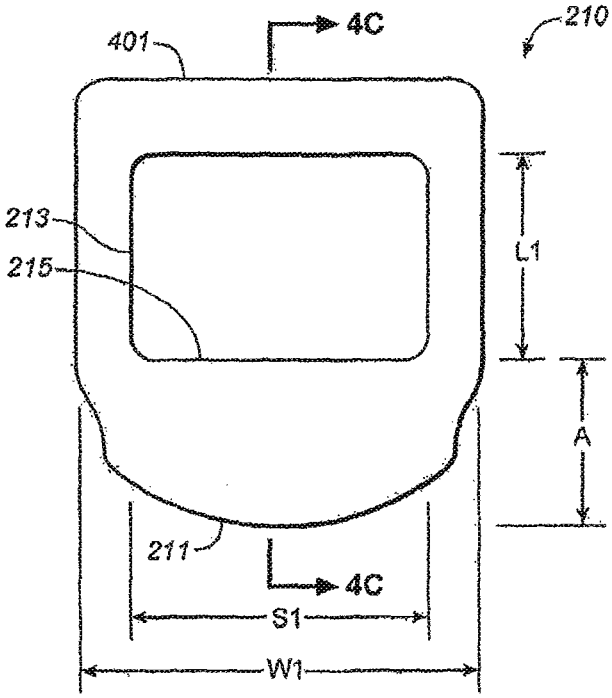
Figure 4C:
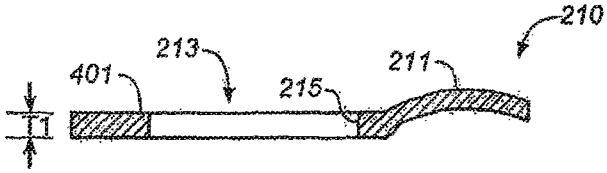
Figure 5A:
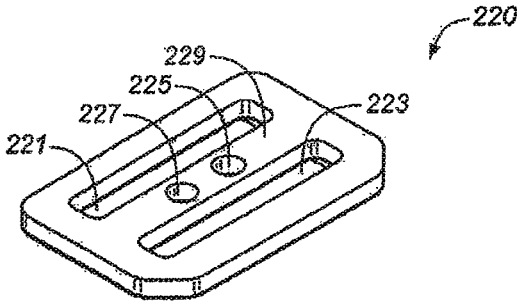
FIGS. 5A, 5B, and 5C are perspective, top, and side views, respectively, of the second element of the first embodiment of a strap-length adjuster.
Figure 5B:
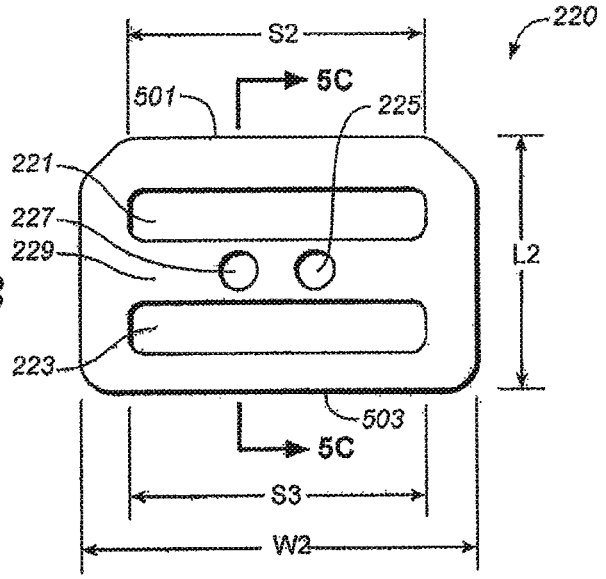
Figure 5C:
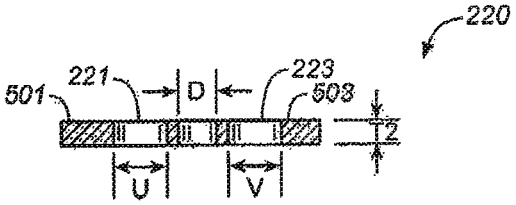
Figure 6A:
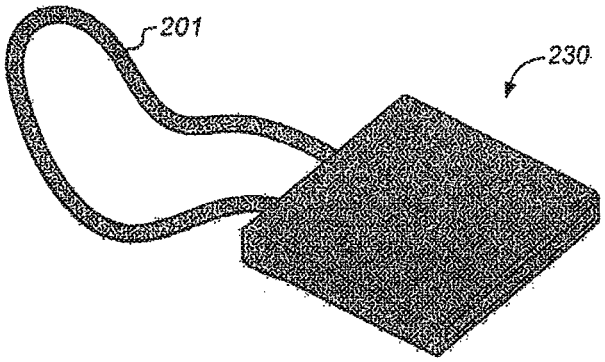
FIGS. 6A, 6B, and 6C are perspective, top, and side views, respectively, of the first embodiment of a strap keeper and tether.
Figure 6B:
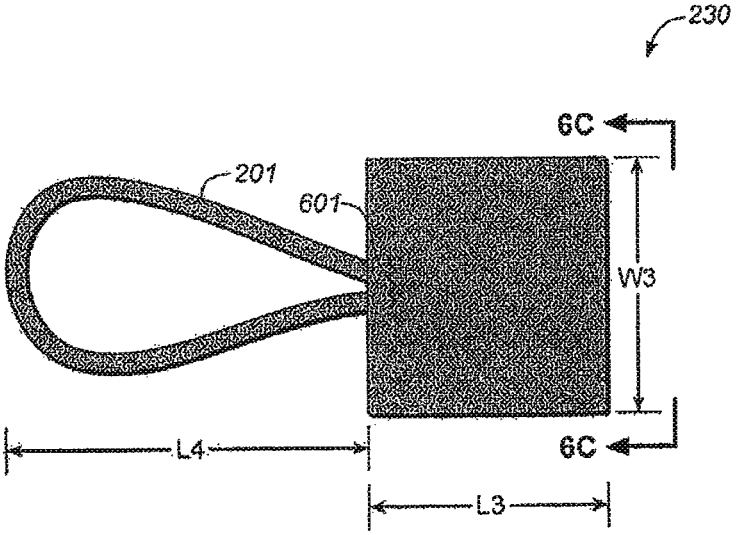
Figure 6C:
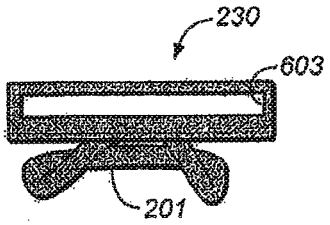

One embodiment of strap adjuster and keeper 100, which is generally similar to first strap adjuster and keeper 100*a* or second strap adjuster and keeper 100*b*, is shown in FIGS. 2-6, where FIG. 2 is a detailed perspective view of another embodiment of the strap adjuster and keeper, FIGS. 3A and 3B are a top and bottom view, respectively, of the strap adjuster and keeper, FIGS. 4A, 4B, and 4C are a perspective view, a top view, and a side view, respectively, of the first element of a strap-length adjuster, FIGS. 5A, 5B, and 5C are perspective, top, and side views, respectively, of the second element of a strap-length adjuster, and FIGS. 6A, 6B, and 6C are perspective, top, and side views, respectively, of a strap keeper and tether.

As shown in FIGS. 2, 3A, and 3B, strap adjuster and keeper 100 includes a strap-length adjuster (or "strap adjuster") 200, a strap keeper 230, and a tether 201 that connects the strap-length adjuster 200 to the strap keeper 230. Strap 15 is generally similar to straps 15*a* and 15*b* and end 13 is generally similar to ends 13*a* and 13*b* except as explicitly noted.

Strap-length adjuster 200 includes a first ring 210 and a second ring 220, both of which may be generally flat and rectangular rings, and have one or more openings. First ring 210, which is shown in greater detail in FIGS. 4A, 4B, and 4C, has an opening 213 with a tab 211 and a surface 215 at one end, and a bar 401 at an opposing end. First ring 210 has a thickness T1 and a width W1, and opening 213 has a width S1 that is sized to accept the width of strap 11 and a length L1, and tab 211 protrudes a distance A from the opening.

Second ring 220, which is shown in greater detail in FIGS. 5A, 5B, and 5C, has a first opening 221 and a second opening 223 separated by a crossbar 229. Specifically, first opening 221 is bounded on one side by a first bar 501 and on the opposite side by crossbar 229, and second opening 223 is bounded on one side by the crossbar 229 and on the opposite side by a second bar 503. Crossbar 229 has a first hole 225 and a second hole 227 forming passageways through second ring 220. Second ring 220 has a thickness T2, length L2, and width W2. First opening 221 has a width S2 and length U sized to accept loop 12, and second opening 223 has a width S3 and length V sized to accept the width of strap 13. Holes 225 and 227 each have a diameter D sized to accept tether 201.

Strap keeper 230, which is shown in greater detail in FIGS. 6A, 6B, and 6C, has an opening 603 sized to accept two layers of strap 13. Strap keeper 230 has a width W3 sized to accept the width of strap 13, and a length L3. Tether 201 is a loop of material of length 2×L4 that is attached to strap keeper 230, for example, by stitches 601 to the inside surface of opening 603.

In general, first ring 210 and second ring 220 are formed from a rigid material, such as metal, plastic, aluminum or steel. In one embodiment, straps 11 and 13 both have a width of 38 mm and a thickness of 2 mm, and rings 210 and 220 are sized, for example and without limitation, with T1=3 mm, L1=27 mm, W1=53 mm, S1=39 mm, A=22 mm, T2=3 mm, L2=34 mm, W2=52 mm, S2=39 mm, U=7 mm, S3=39 mm, V=7 mm and D=5 mm. In other embodiments, straps 11 and 13 may have the same or different sizes, ranging from 6 mm to 75 mm, and the sizes of rings 210 and 220 may be sized appropriately.

Strap keeper 230 is formed from elastic or inelastic webbing. For the example wherein straps 11 and 13 both have a width of 38 mm and a thickness of 2 mm, W3 may be 38 mm and L3 may be 38 mm.

Tether 201 may be formed from elastic or inelastic cord or line. The length L4 may be, for example and without limitation, from 25 mm to 100 mm. The length L4 may thus be 25 mm, 50 mm, 75 mm, or 100 mm.

In an alternative embodiment, tether 201 passes through one hole in crossbar 229, and is knotted to secure the tether to second ring 220.

Figure 7A:
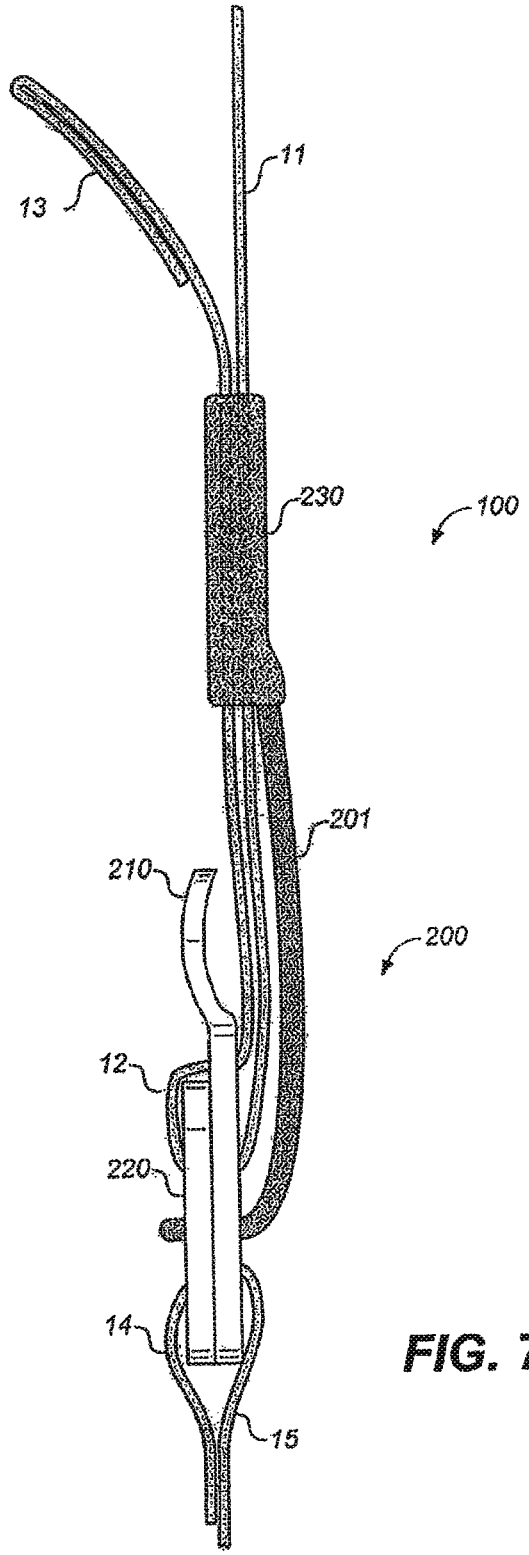
FIG. 7A is a side view of the first embodiment of a strap adjuster and keeper in a "locked" configuration.

FIG. 7A is a side view of strap adjuster 200 and strap keeper 230 in a "locked" configuration. Loop 14 is secured over bar 401 through opening 213, and over bar 503 through opening 223. Loop 12 is formed by passing end 13 first through opening 213, then through opening 221, over bar 501, and back through opening 213, as is also shown in FIGS. 2, 3A, and 3B. Loop 12 is thus provided with frictional forces from first ring 210 on surface 215 and second ring 220 to prevent slippage of strap 11. In addition, tether 201 retains the movement of strap keeper 230, keeping strap keeper 230 near strap-length adjuster 200, thus keeping the portions of strap 11 near each other.

Figure 7B:
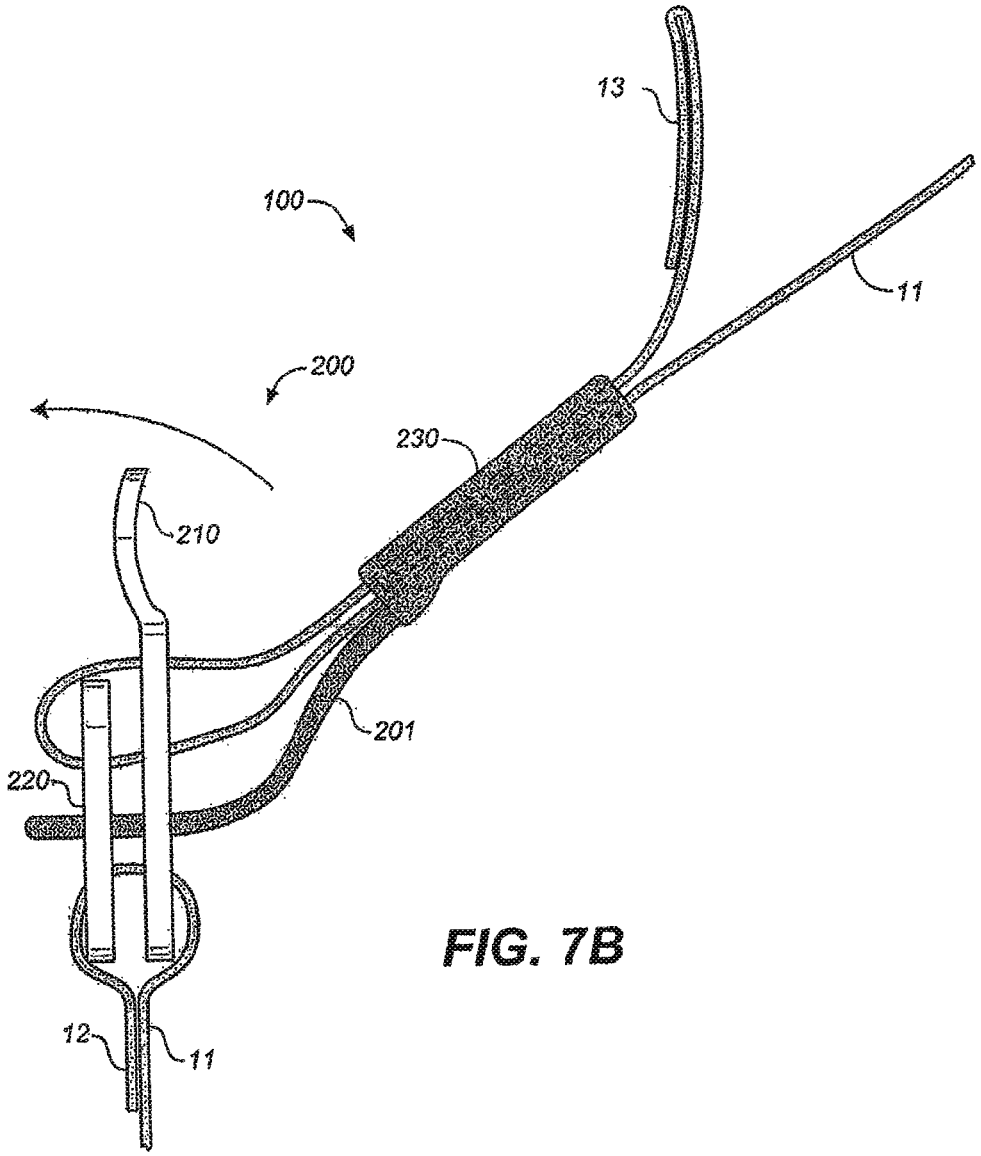
FIG. 7B is a side view of the first embodiment of a strap adjuster and keeper configured for adjusting the length of the strap.

FIG. 7B is a side view of strap adjuster 200 and strap keeper 230 configured for adjusting the length of strap 11. When tab 211 is moved away from strap 11, the hold of first ring 210 and second ring 220 on strap 11 is loosened, permitting the movement of strap 11 through strap keeper 230 to either lengthen or shorten strap 11. Tether 201 continues to retain the movement of strap keeper 230 to be near strap-length adjuster 200. It is apparent from FIGS. 7A and 7B that tether 201 limits the distance between strap-length adjuster 200 and strap keeper 230, while not interfering with the movement of strap 11, when required.

Figure 8A:
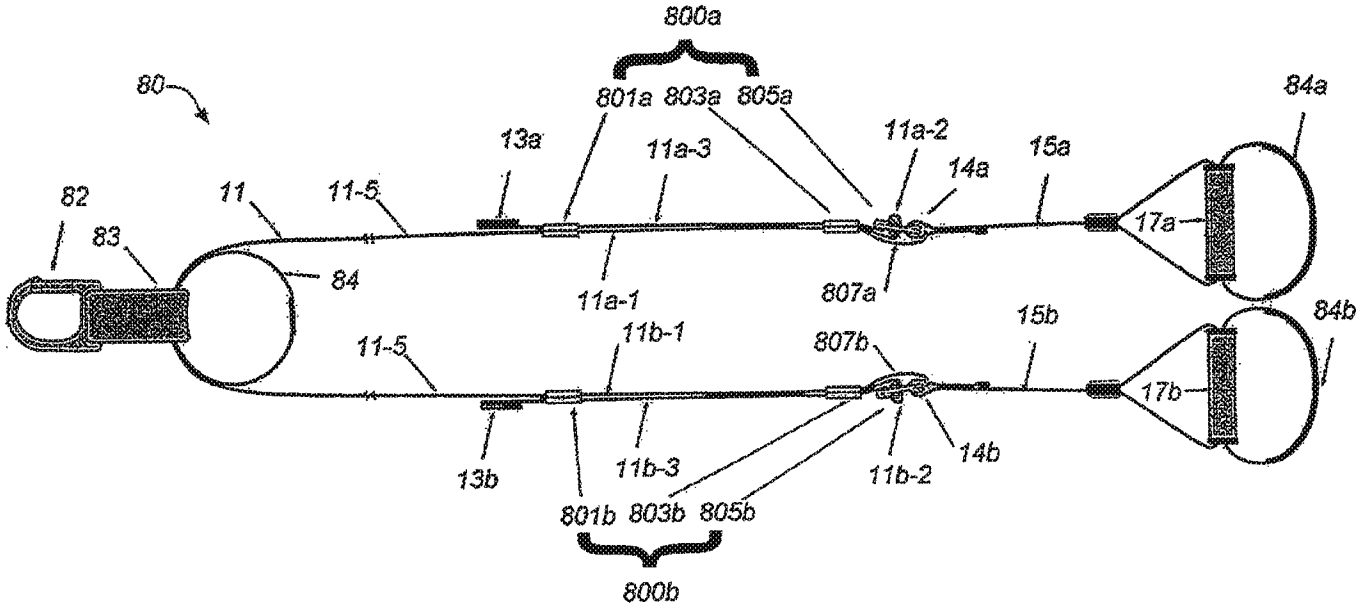
FIGS. 8A and 8B are a top view and a side view, respectively, of a second embodiment of a strap adjuster and keeper.
Figure 8B:
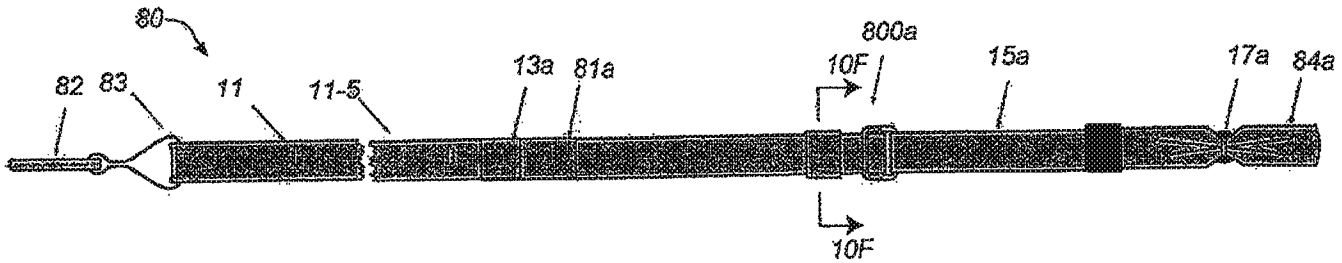

FIGS. 8A and 8B are a top view and a side perspective view, respectively, of a second embodiment of a strap adjuster and keeper 800, shown as a strap adjuster and keeper 800*a* and 800*b* as utilized in an exercise device 80. Exercise device 80 is shown for illustrative purposes only and is not meant to limit the scope of the present invention, except as explicitly claimed.

Exercise device 80, for example, includes a carabiner 82 connected to an anchor strap 83, a first inelastic strap 11 supported by anchor strap 83 and having free ends 13 (i.e., a first free end 13*a* and a second free end 13*b*), and second and third inelastic straps 15*a* and 15*b* terminating in grips 17*a* and 17*b*, respectively. Grips 17*a* and 17*b* support secondary user support straps 84*a* and 84*b*, respectively. Strap adjuster and keeper 800, shown as a first strap adjuster and keeper 800*a* and a second strap adjuster and keeper 800*b*, accepts free ends 13*a* and 13*b*, respectively, and permits adjustment of the supporting length of first strap 11 by pulling on one or more of first free end 13*a* and second free end 13*b*, as discussed subsequently.

Each strap adjuster and keeper 800 (i.e., strap adjuster and keepers 800*a* and 800*b*) includes an end strap keeper 801 (i.e., a first end strap keeper 801*a* and a second end strap keeper 801*b*), a tethered strap keeper 803 (i.e., a first tethered strap keeper 803*a* and a second tethered strap keeper 803*b*), a strap adjuster 805 (i.e., a first strap adjuster 805*a* and a second strap adjuster 805*b*), and a tether 807 (i.e., a first tether 807*a* and a second tether 807*b*).

Strap keepers 801 and 803 are generally similar to strap keeper 230, strap adjuster 805 is generally similar to strap adjuster 200, and tether 807 is generally similar to tether 201, except as explicitly noted.

Strap 11 may be formed from one or more inelastic materials and may be considered to be divided into: 1) a portion 11*a*-3, which extends from free end 13*a* and passes through first end strap keeper 801*a*, through first tethered strap keeper 803*a*, to a strap fold 11*a*-2 in first strap adjuster 805*a;* 2) a portion 11*a*-1, which extends from strap fold 11*a*-2 in first strap adjuster 805*a*, through first tethered strap keeper 803*a* and first end strap keeper 801*a;* 3) a portion 11-5 which extends from first end strap keeper 801*a* to second end strap keeper 801*b;* 4) a portion 11*b*-1, which extends through second end strap keeper 801*b*, second tethered strap keeper 803*b*, to a strap fold 11*b*-2 in second strap adjuster 805*b*; and 5) a portion 11*b*-3, which extends from strap fold 11*b*-2 in second strap adjuster 805*b*, through second tethered strap keeper 803*b* and second end strap keeper 801*b* and ends at free end 13*b*.

First strap adjuster and keeper 800*a* and second strap adjuster and keeper 800*b* also support second strap 15*a* and third strap 15*b*, respectively. Thus, for example, strap 15*a* includes a loop 14*a* that is attached to first strap length adjuster 805*a*, and strap 15*b* includes a loop 14*b* that is attached to second strap length adjuster 805*b*.

In an embodiment: first end strap keeper 801*a* is attached to portion 11*a*-3 and can slide along portion 11*a*-1, and second end strap keeper 801*b* is attached to portion 11*b*-3 and can slide along portion 11*b*-1; first tether 807*a* connects to first tethered strap keeper 803*a* and passes through loop 14*a* of strap 15*a*, and second tether 807*b* connects to second tethered strap keeper 803*b* and passes through loop 14*b* of strap 15*b*.

Figure 9A:
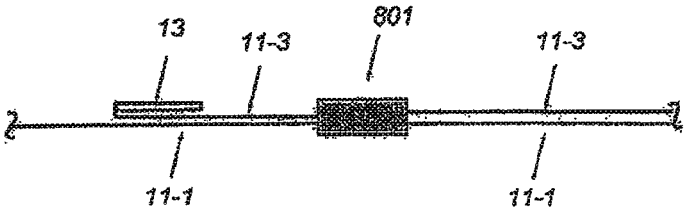
FIGS. 9A, 9B, and 9C are a top view, a side view, and a sectional view, respectively, of the detail of the strap ends on the embodiments of FIGS. 8A and 8B.
Figure 9B:
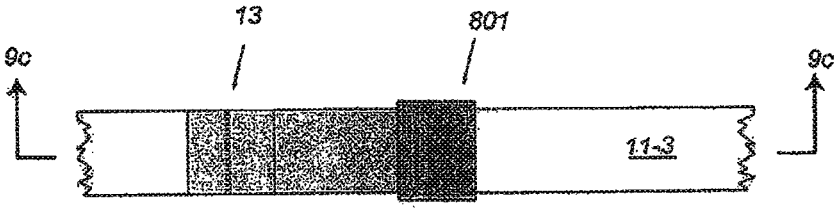
Figure 9C:
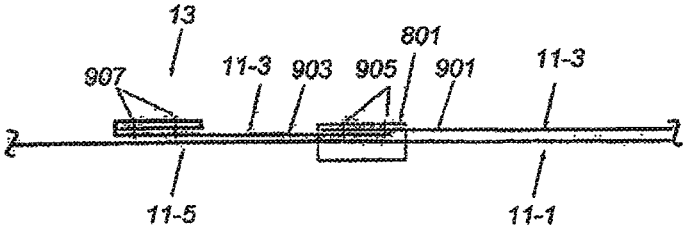

FIGS. 9A, 9B, and 9C are a top view, a side view, and a sectional view, respectively, of the detail of the strap ends on the embodiments of FIGS. 8A and 8B. FIG. 9C shows that strap portion 11-3 (which may be portion 11*a*-3 or 11*b*-3) includes a first strap material 901 and a second strap material 903. Strap materials 901 and 903 are stitched to each other and to strap keeper 801. The end of strap 13 is formed by stitches 907 in strap material 903.

FIG. 10A is a perspective view of one embodiment of a tethered strap keeper 803 and a strap-length adjuster 805. FIGS. 10B-10E are assembly drawings for one embodiment of a tethered strap keeper, wherein tether 807 is sewn into an inelastic piece 1001, which is then sewn into an outer shell 1003. With the piece shown in FIG. 10E inverted (turned inside-out), strap portions 11-1 and 11-3 are threaded on either side of piece 1001. As shown in the sectional view of FIG. 10F (which is taken from FIG. 8B), strap portions 11-1 and 11-3 are separated within strap keeper 803 by piece 1001, to which tether 807 is attached, and strap 11 is free to move relative to tethered strap keeper 803.

FIGS. 11A and 11B are a top view and side view, respectively, of strap adjuster 805. Strap adjuster 805, sometimes referred to herein as a "barrel lock," is similar to a "triglide buckle," where the center piece is movable to facilitate securing a strap. Thus, for example, strap adjuster 805 is shown as including a frame 1101 and a movable gate 1103, as indicated in FIG. 11B.

Figure 11C:
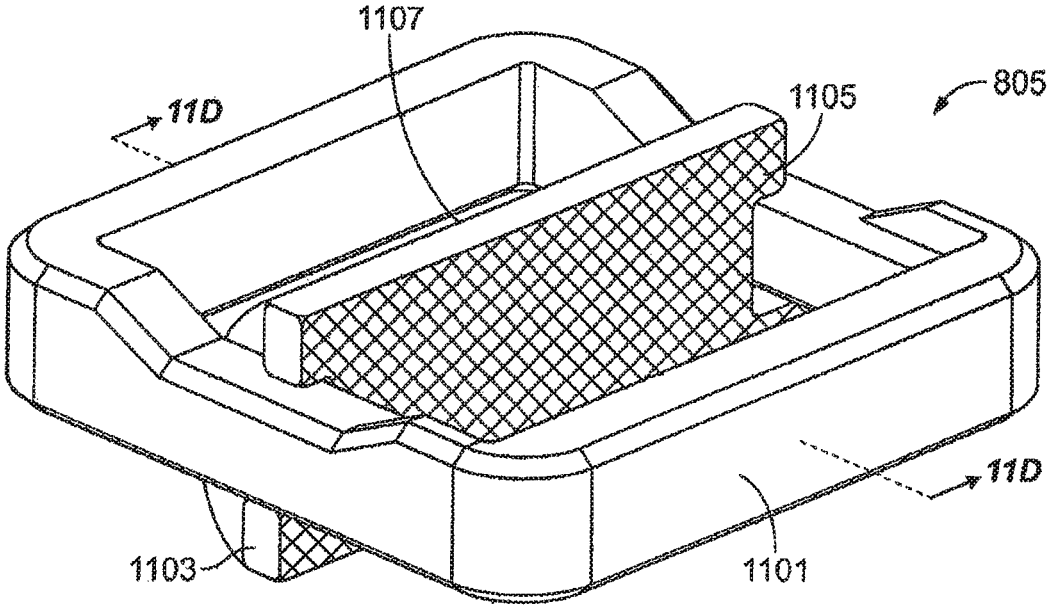
FIGS. 11C and 11D are a perspective view and a cross-sectional view along line 11D-11D, respectively, of a second embodiment of a barrel lock.
Figure 11D:
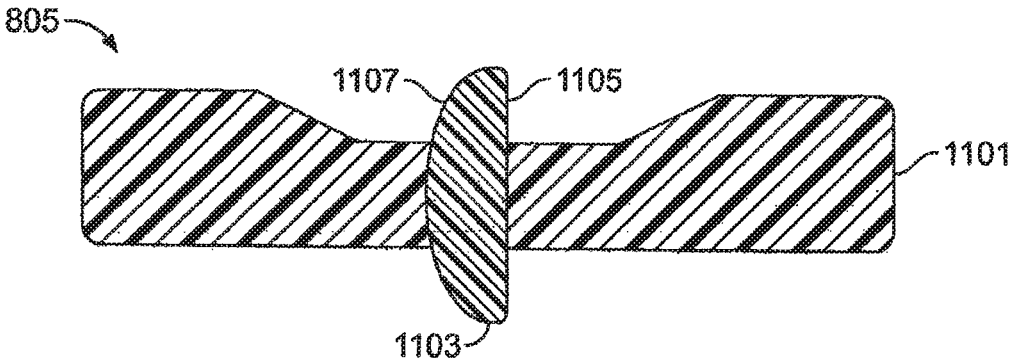

In an embodiment, movable gate 1103 may be substantially rounded, as depicted in FIGS. 11A and 11B. In another embodiment, movable gate 1103 may have a flattened surface 1105 on the portion closest to strap keeper 803 and a rounded surface 1107 on the portion farthest from strap keeper 803, as depicted in FIGS. 11C and 11D. The movable gate 1103 may be configured to increase the gripping force between the strap adjuster 805 and the strap 11 by increasing the friction between the movable gate 1103 and the strap 11. In an embodiment, the flattened surface 1105 is rough or textured while the rounded surface 1107 is smooth. As will be clear to one of skill in the art, this configuration increases the friction between the strap 11 and the strap adjuster 805 as the strap 11 is pressed against the flattened surface 1105, thereby preventing the strap 11 from moving through the strap adjuster 805 when tension is applied, for example, through strap portion 11-5 and strap 15*a*. This configuration may be desirable, for example, to securely restrain the strap 11 when the device 80 is in use. This configuration still allows strap 11 to easily slide through the strap adjuster 805 when tension is applied through free end 13*a* and strap 15*a*, as the strap 11 will primarily contact the movable gate 1103 via the rounded surface 1107. This allows, for example, the distance between the anchor strap 83 and the grip 17*a* to be easily decreased. Additionally, the distance between the anchor strap 83 and the grip 17*a* may be easily increased by turning the strap adjuster 805*a* so that the strap 11 is substantially perpendicular to the frame 1101. In this fashion, the strap 11 primarily contacts the rounded surface 1107 of the movable gate 1103, thereby decreasing the friction between the movable gate 1103 and the strap 11. In another embodiment, the entity of the movable gate 1103 is rounded and smooth, aside from the flattened surface 1105, to more easily allow the strap 11 to slide along the rounded portions of the movable gate.

Figure 12A:
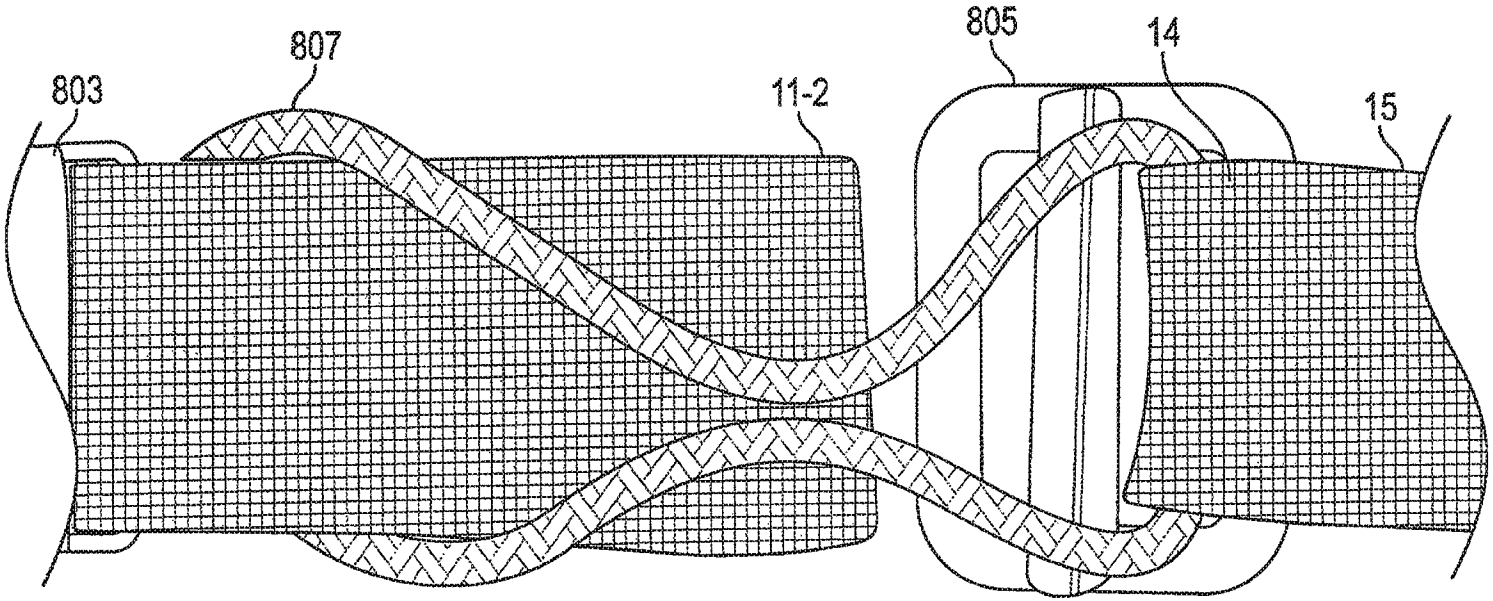
FIGS. 12A, 12B, and 12C illustrate the safety aspects of the embodiment of FIGS. 8-11 in the event that the barrel lock fails.
Figure 12B:
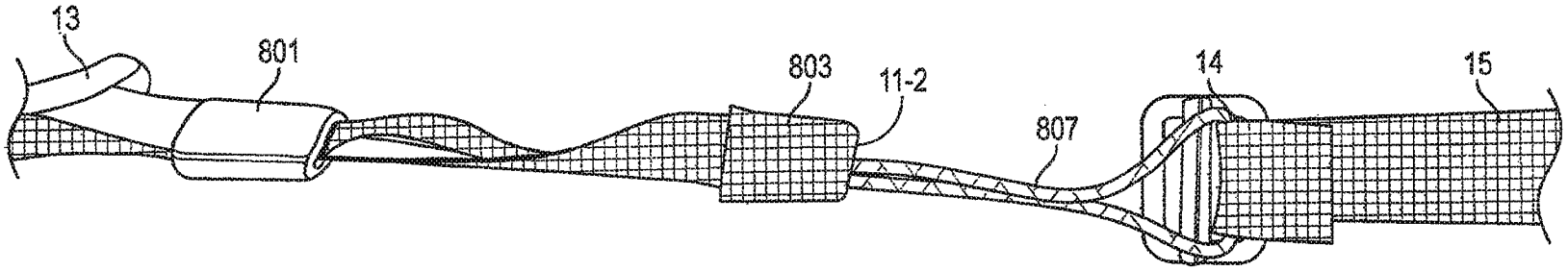
Figure 12C:
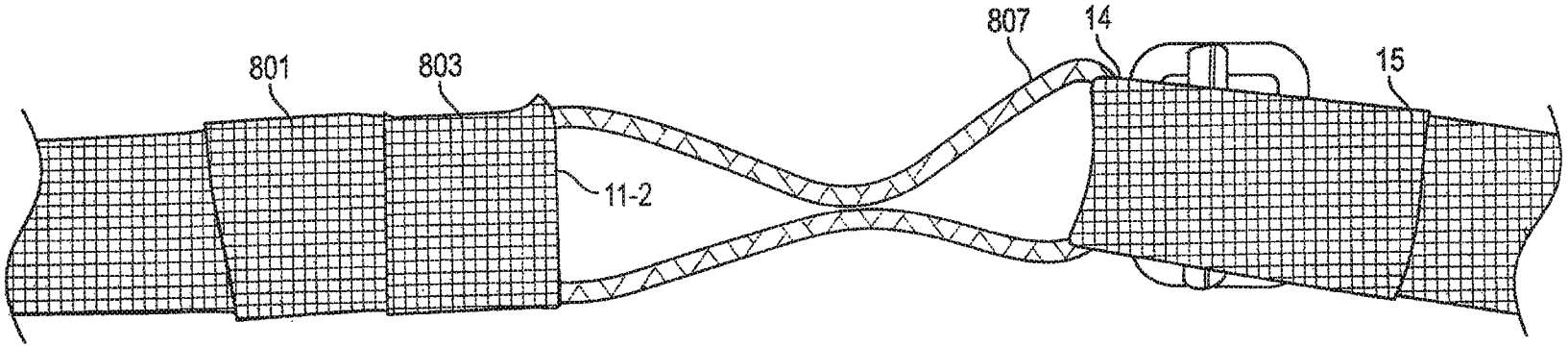

From the above description, it will be obvious that tether 807 extends from strap 11 to strap 15 and thus may provide some support to prevent or slow the separation of components of exercise device 80. FIGS. 12A, 12B, and 12C illustrate the safety aspects of the embodiment of FIGS. 8-11 in the event of a failure of the barrel lock of strap adjuster 805.

FIG. 12A shows strap 11 separated from strap adjuster 805. This separation may occur, for example and without limitation, by a mechanical failure of gate 1103. In the event that such a failure occurs when exercise device 80 is in use, tension within straps 11, 15*a*, and 15*b* will cause strap 11 to move away from strap 15.

FIG. 12B shows the result of tension on the straps due to force F, which causes an increase in length of strap 11, as measured by the distance between a grip 17 and anchor strap 83, for example. The length of portion 11-3 decreases as strap end 13 and strap keeper 801 are pulled towards strap keeper 803, while strap fold 11-2 is pulled into strap keeper 803, where it is stopped by and supported by piece 1001.

FIG. 12C shows the device at a later time. Strap end 13 and strap keeper 801 have moved together, with portion 11-3 having a minimum distance. At this point, the force between straps 11 and 15 is supported by tension in tether 807. Depending on the strength of tether 807 and its connections to strap keeper 803, the tether may prevent further lengthening of device 80, or it may then fail, albeit in a slower and more controlled manner than if tether 807 was not present.

Figure 13A:
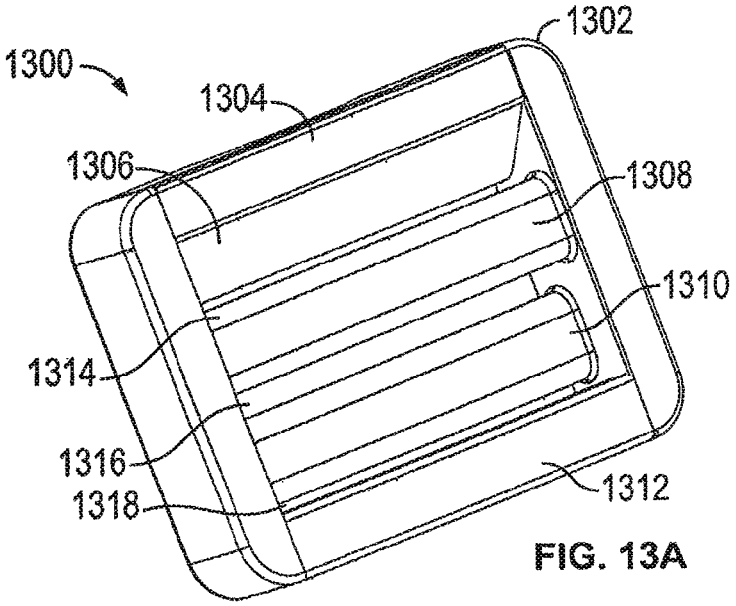
FIGS. 13A, 13B, and 13C are a perspective view, a top view and a side view, respectively, of a third embodiment of a strap length adjustment mechanism.
Figure 13B:
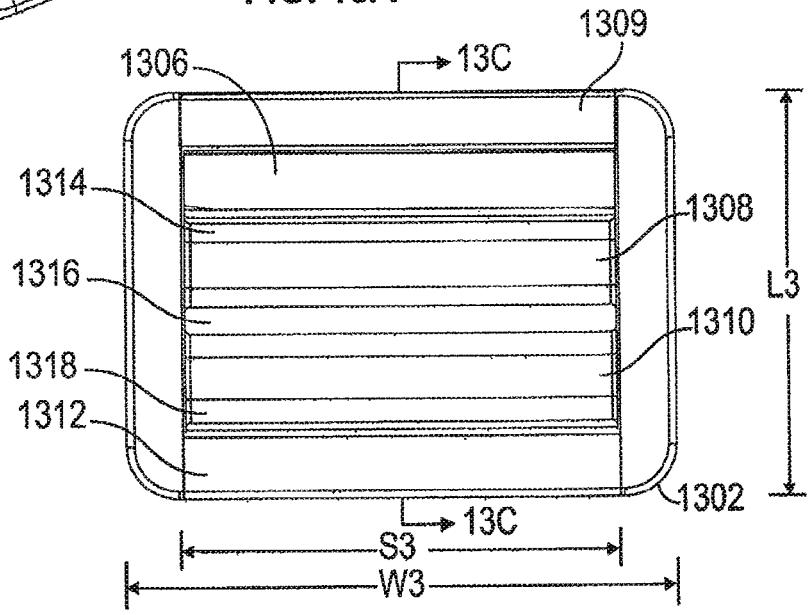
Figure 13C:
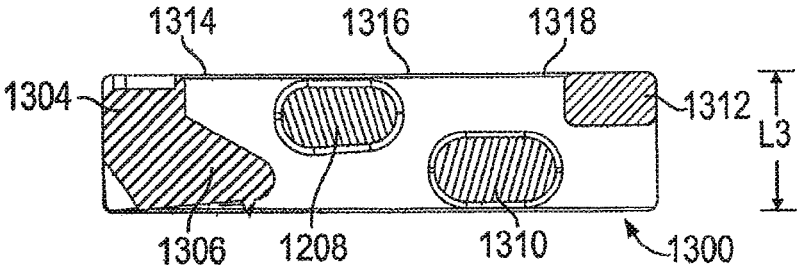

FIGS. 13A, 13B, and 13C are a perspective view, a top view, and a side view, respectively, of strap adjuster 1300, which is also referred to as a "tension lock." As will be appreciated by one of skill in the art, strap adjuster 1300 may be used in place of, for example, strap adjuster 200 or strap adjuster 805.

As shown in FIGS. 13A, 13B, and 13C, strap adjuster 1300 includes a frame 1302, which may be generally flat and rectangular in shape and have one or more openings. Frame 1302 has a first end bar 1304 and a second end bar 1312 located at opposite ends of the frame 1302 and separated by a first opening 1314, a first crossbar 1308, a second opening 1316, a second crossbar 1310, and a third opening 1318. More specifically, first end bar 1304 is separated from first crossbar 1308 by first opening 1314; first crossbar 1308 is separated from second crossbar 1310 by second opening 1316; and second crossbar 1310 is separated from second end bar 1312 by third opening 1318. An interior protrusion 1306 may be located adjacent to first end bar 1304 so as to be between first end bar 1304 and first opening 1314.

As shown in FIGS. 13B and 13C, strap adjuster 1300 has a thickness T5, a length L5, a width W5, and an opening width S5. In general, strap adjuster 1300 is formed from a rigid material, such as metal, plastic, aluminum or steel. In one embodiment, strap adjuster 1300 may be used with straps 11 and 13 (shown for example in FIGS. 12A-C) where both straps 11 and 13 have a width of 38 mm and a thickness of 2 mm, and strap adjuster 1300 is sized, for example and without limitation, with T5=3 mm, L5=27 mm, W5=53 mm and the opening width S5 is 38 mm wide. In other embodiments, straps 11 and 13 may have the same or different sizes, ranging from 6 mm to 75 mm, and the size of strap adjuster 1300 may be sized appropriately.

As shown in FIG. 13C, the interior protrusion 1306 may be shaped to comprise a first wall that is substantially perpendicular to the top surface of the frame 1302, a second wall that is adjacent to the first wall and slopes away from the first wall, and a third wall that is substantially opposite the top surface of the frame 1302 and may be separated from the second wall by a rounded portion. All or part of the interior protrusion 1306 may be configured to increase the gripping force applied to a strap 11 by increasing the friction between the interior protrusion 1306 and the strap 11. In an embodiment, only the third wall of the interior protrusion 1306 is configured to increase the friction between the interior protrusion 1306 and a strap 11. For example, the third wall may be rough or textured or may include one or more projections. These one or more projections may be triangular in shape. One of skill in the art will readily appreciate that additional shapes may be used for the protrusions.

As shown in FIG. 13C, in an embodiment the first crossbar 1308, second crossbar 1310, and second end 1312 may be rounded and/or smooth. As will be clear to one of skill in the art, such configuration reduces the friction between these elements and straps 11 and 15, thereby allowing the straps to more easily slide through the strap adjuster 1300. This offers several advantages, for example preventing unnecessary wear on strap 15 (shown in FIG. 14A as strap portions 1406 and 1408) as strap 15 rubs against the strap adjuster 1300. Similarly, this allows strap 11 to easily move through the strap adjuster 1300 when the strap adjuster is moved to be perpendicular to the strap 11, such that strap 11 primarily contacts the rounded portion of first crossbar 1310. Additional benefits will be readily apparent to one of skill in the art.

Figure 14A:
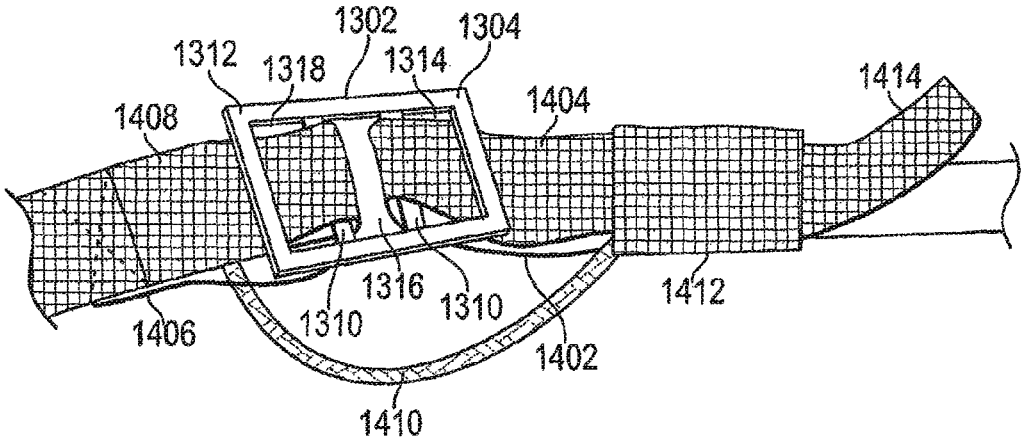
FIGS. 14A and 14B are a perspective view and a bottom view, respectively, of the embodiments of FIGS. 13A-13C of the strap-length adjustment mechanism with a tethered strap keeper.
Figure 14B:
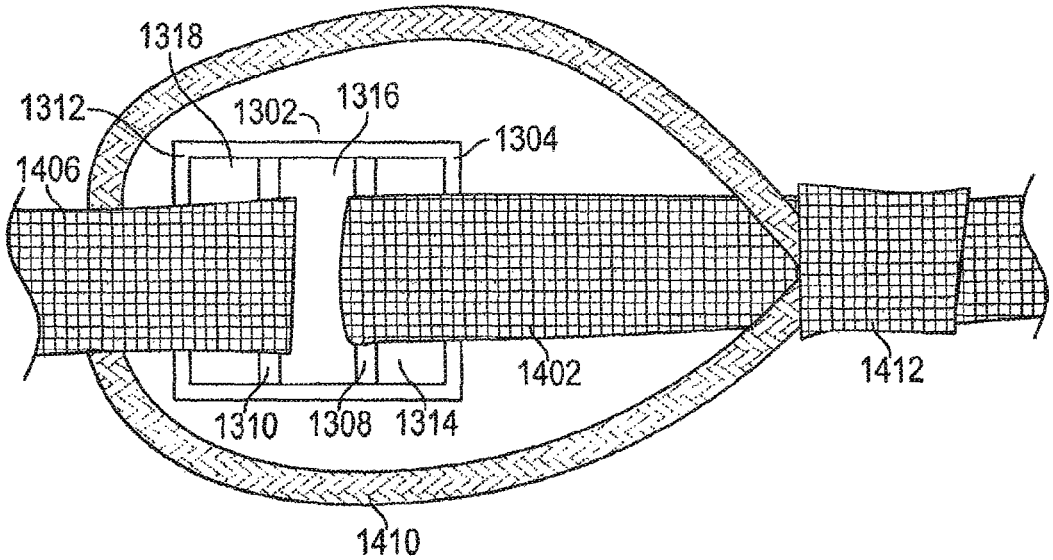

FIGS. 14A and 14B are a perspective view and a bottom view, respectively, of an embodiment of strap adjuster 1300 in use, for example, in an exercise device such as exercise device 80. In this example, strap portions 1402 and 1404 may be portions of first strap 11, while strap portions 1406 and 1408 may be portions of strap 15*a*. In this configuration, strap adjuster 1300 allows the length of strap 11 to be adjusted by increasing or decreasing the length of the portion of strap 11 that is folded over, that is, the length of portion 1404.

Strap keeper 1412 (also referred to as a strap restraint) is generally similar to strap keepers 230 and 803, strap adjuster 1300 is generally similar to strap adjusters 200 and 805, and tether 1410 is generally similar to tethers 201 and 807, except as explicitly noted.

As shown, first bottom strap portion 1402 passes up through second opening 1316, over first crossbar 1308, and down through first opening 1314 and under first end bar 1304, becoming first top strap portion 1404 which terminates in strap end 1414. Second bottom strap portion 1406 passes up through second opening 1316, over second crossbar 1310, down through third opening 1318 and under second end bar 1312 to become second top strap portion 1408. Strap portions 1406 and 1408 are attached together, forming a closed loop around second crossbar 1310. In contrast, strap end 1414 is left free, allowing for the adjustment of the length of strap 11 by pulling on strap end 1414.

Both first bottom strap portion 1402 and first top strap portion 1404 pass through strap keeper 1412. Strap keeper 1412 is similar to end strap keeper 803 and is configured to hold strap portions 1402 and 1404 together. Strap keeper 1412 slides along strap portions 1402 and 1404, allowing for the length of strap 11 to be adjusted. Strap restraint 1412 is attached to tether 1410, which is similar to tether 807. Tether 1410 passes through the closed loop formed by strap portions 1406 and 1408. Similar to tether 807, tether 1410 secures strap 11 to strap 15 and thus may provide some support to prevent or slow the separation of components of the exercise device. Additionally, tether 1410 serves to keep strap keeper 1412 near strap adjuster 1300.

With reference to FIG. 8, in an embodiment, distinctive colors are used on the exercise device 80 to quickly convey to users the proper way to adjust the distance between the grip 17*a* and the anchor strap 83. For example, strap ends 13*a* and 13*b* may be colored bright yellow while the remainder of strap 11 is colored black. Similarly, straps 15*a* and 15*b* may be colored bright yellow. In this example, a user would place one hand on the yellow portion at strap end 13*a* and the other hand on the yellow portion of strap 15*a* in order to decrease the length between the grip 17*a* and the anchor strap 83 by increasing the length of the portion 11*a*-3 of strap 11 that is folded over. The distance between the grip 17*a* and the anchor strap 83 could be shortened by pulling apart on these two yellow portions 13*a* and 15*a*. Conversely, to lengthen the distance between the grip 17*a* and the anchor strap 83, the user could place one hand on the yellow portion of strap 15*a* and a second hand on the strap-length adjuster 805*a*. The distance between the grip 17*a* and the anchor strap 83 could then be increased by pulling on the yellow portion of strap 15*a* while lifting strap adjuster 805*a* towards the user. This use of distinctive colors to highlight the portions 13*a* and 15*a* of the strap 11 that should be grabbed in order to adjust the distance between the grip 17*a* and the anchor strap 83 makes the exercise device 80 easier to use, particularly in a group setting wherein an instructor must quickly convey instructions to a large number of users on how to use the device 80.

In another embodiment, distinctive markings may be made along strap 11 to indicate to a user where the strap ends 13*a* and 13*b* should be positioned for particular exercises. For example, a marking such as the letter "A" could be placed on each of strap portions 11*a*-1 and 11*b*-1 so that the distances between each letter "A" and the anchor strap 83 are equal to a first predetermined distance. By positioning strap ends 13*a* and 13*b* on the markings, the distance between the anchor strap 83 and the first grip 17*a* will be equal to the distance between the anchor strap 83 and the second grip 17*b*. The marking of the letter "A" thus indicates a first position. In a similar fashion, additional letters (e.g., "B" and "C") could be placed on each of strap portions 11*a*-1 and 11*a*-2 to indicate additional positions. As will be clear to one of skill in the art, other markings such as arabic numbers (e.g., "1" and "2"), roman numerals (e.g., "I" and "II"), or any other type of marking could also be used. These markings could be created, for example, by stitching them on to the strap 11. Other methods of creating these markings will be clear to one of skill in the art. These markings may be made in a distinctive color that is different from the color of the strap 11. For example, the markings could be made in a bright yellow color while the strap 11 is black. In addition to ensuring the distances between the anchor strap 83 and each of the grips 17*a* and 17*b* are equivalent, these markings allow a group of users, each user with a separate exercise device 80, to quickly adjust each user's individual exercise device to the same configuration. Further, these markings allow an individual user to quickly and reliably adjust the exercise device 80 to a desired configuration that has previously been used.

In an embodiment, the markings and the portions of the device 80 (e.g., strap portions 13*a* and 15*a*) with which a user must interact in order to adjust the device 80 are done in the same color (e.g., bright yellow) while the remainder of the device is a different color (e.g., black). In this embodiment, a user will quickly be able to determine the proper method for adjusting the device.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

What is claimed is:

1. An apparatus for attaching to a closed loop of a first strap and for providing a gripping force to a second strap having a first portion and a second portion, wherein said first portion is folded over adjacent to said second portion, said apparatus comprising:

a strap restraint, wherein said strap restraint encircles said first portion and said second portion, holding said first portion adjacent to said second portion;

a tether, wherein said tether is operatively connected to said closed loop and is operatively connected to said strap restraint; and a strap-length adjuster, comprising:

a frame comprising a first bar and a second bar; and a movable gate, wherein said movable gate is movably connected to said frame and is separated from said first bar by a first opening and from said second bar by a second opening;

wherein said closed loop encircles said first bar; and wherein said second strap passes through said first opening, over said movable gate, through said second opening, and under said second bar.

2. The apparatus of claim 1, wherein said movable gate further comprises:

a first surface adjacent to said second bar; and a second surface opposite said second bar;

wherein said first surface is configured to increase said gripping force by increasing the friction between said first surface and said second strap.

3. The apparatus of claim 2, wherein said second surface is configured to reduce the friction between said second surface and said second strap.

4. The apparatus of claim 3, wherein said first surface is substantially rough and said second surface is substantially smooth.

5. The apparatus of claim 1, wherein said movable gate is substantially parallel to said first bar and said second bar.

6. The apparatus of claim 5, further comprising:

wherein said movable gate includes a first protrusion which overlaps and is adjacent to a top surface of said frame and a second protrusion which overlaps and is adjacent to a bottom surface of said frame; and wherein said top surface of said frame is located opposite said bottom surface of said frame;

such that a section of said frame located between said first bar and said second bar is also located between said first protrusion and said second protrusion.

7. The apparatus of claim 1, wherein said tether passes through said closed loop.

* * * * *